US005942057A

United States Patent [19]

Hanamura et al.

[11] Patent Number: 5,942,057

[45] Date of Patent: Aug. 24, 1999

[54] PROCESS FOR PRODUCING TIAL INTERMETALLIC COMPOUND-BASE ALLOY MATERIALS HAVING PROPERTIES AT HIGH TEMPERATURES

[75] Inventors: Toshihiro Hanamura; Youji Mizuhara; Keizo Hashimoto, all of Kawasaki, Japan

[73] Assignee: Nippon Steel Corporation, Tokyo-to, Japan

[21] Appl. No.: 08/714,049

[22] PCT Filed: Mar. 9, 1995

[86] PCT No.: PCT/JP95/00387

§ 371 Date: Apr. 11, 1997

§ 102(e) Date: Apr. 11, 1997

[87] PCT Pub. No.: WO95/24511

PCT Pub. Date: Sep. 14, 1995

[30] Foreign Application Priority Data

Mar. 10, 1994 [JP] Japan ..... 6-66621
Feb. 10, 1995 [JP] Japan ..... 7-46559

[51] Int. Cl.[6] ..... C22F 1/18

[52] U.S. Cl. ..... 148/670; 148/421; 148/669

[58] Field of Search ..... 148/669, 670, 148/671, 421; 420/418

[56] References Cited

U.S. PATENT DOCUMENTS 4,915,905 4/1990 Kampe et al. ..... 420/418
5,284,620 2/1994 Larsen ..... 148/421
5,354,351 10/1994 Kampe et al. ..... 420/418
5,372,663 12/1994 Shibue et al. ..... 148/669
5,545,265 8/1996 Austin et al. ..... 148/421

*Primary Examiner*—John Sheehan
*Attorney, Agent, or Firm*—Pollock, Vande Sande & Amernick

[57] ABSTRACT

A TiAl intermetallic compound-base alloy material having excellent strength properties at high temperatures and ductility, characterized by comprising: a fine alumina ($Al_2O_3$) dispersed so as to give an $O_2$ concentration of 1000 to 5000 ppm by weight and in a particle diameter of 200 to 500 nm; a boride ($TiB_2$) dispersed to give a B concentration of 0.1 to 10 at % and in a particle diameter of not more than 500 nm; 1 to 3 at % of at least one of Cr, Mn, and V; and TiAl having a Ti content of 50 to 53 at % and an Al content of 47 to 50 at %, said TiAl intermetallic compound-base alloy material having been directly cast at a cooling rate of $10^3$ to $10^{5°}$ C./sec and a process for producing the same. According to the present invention, exhaust valves for automobiles and materials for engine turbines for jet airplanes and the like having excellent tensile strength at high temperatures and ductility at high temperatures and room temperature are provided.

6 Claims, 16 Drawing Sheets

PROCESS FOR PRODUCING TIAL INTERMETALLIC COMPOUND-BASE ALLOY MATERIALS HAVING PROPERTIES AT HIGH TEMPERATURES

TECHNICAL FIELD

The present invention relates to TiAl intermetallic compound-base alloys having excellent tensile strength at high temperatures and ductility at high temperatures and room temperature and a process for producing the same.

BACKGROUND ART

A TiAl intermetallic compound-base alloy material is included among materials under development for use as structural materials having environmental resistance. Since this material has excellent strength properties at high temperatures, the development as a structural material for use at high temperatures in the future is expected in the art. Regarding this material, attention has been drawn to the strength at high temperatures which is comparable to the property values of the conventional Ni-base and Co-base superalloys. Further, it should be noted that the specific gravity of the TiAl intermetallic compound-base alloy material is 3.8 while the specific gravity of the superalloys is close to 10. When this fact is taken into consideration, the TiAl intermetallic compound-base alloy material is superior to the superalloys in specific strength at high temperatures. Therefore, it is a promissing material for advanced airplanes which should be lightweight.

However, the upper limit of the service temperature of alloy materials having strength at high temperatures, such as these superalloys, including TiAl intermetallic compound-base alloy materials is 900° C., and metallic materials having satisfactory strength at 900 to 1100° C. have not been developed in the art. Rather, nonmetallic materials, such as ceramics and C/C (carbon/carbon fibers), are used in temperatures of 1000° C. or above. These nonmetallic materials has high strength at high temperatures. However, fracture, in most cases, is created within elastic stress, so that the ductility is zero. For this reason, the development of alloy materials having ductility has been desired from the viewpoint of safety.

In the prior art, there is a near net shape casting technique where an intermetallic compound sheet is produced. The technique for producing a near net shape sheet has been rapidly advanced in recent years. In particular, in the metallic materials, the advance in the application to the production of stainless steel sheets is significant. Various casting process have been proposed for the production of the sheet. Among them, a twin roll process is suitable for the production of a continuous sheet having an even thickness.

A nickel-aluminum intermetallic compound ($Ni_3Al$) having ductility improved by the addition of a very small amount of boron is known as an example of the application of the above technique to intermetallic compound materials. This has been reported in an international conference concerning "Casting of Near Net Shape Products" held in November 1988 (Proceeding of an International Symposium of Near Net Shape Products, pp. 315–333, issued by The Metallurgical Society). Further, a process for producing a TiAl intermetallic compound sheet is described in Japanese Patent Application No. 501367/1991.

Further, for TiAl intermetallic compound materials with boron added thereto, U.S. Pat. No. 4,842,820 discloses a production process utilizing plasma melt process and isothermal forging, and U.S. Pat. No. 4,751,048 discloses a production process utilizing mechanical alloying.

For TiAl intermetallic compound materials with chromium added thereto, U.S. Pat. Nos. 4,842,819 and 4,879,092 disclose a production process utilizing plasma melt process and isothermal forging.

DISCLOSURE OF INVENTION

An object of the present invention is to provide a TiAl-base intermetallic compound material having enhanced strength properties at high temperatures and, at the same time, to further improve the ductility at room temperature while maintaining the strength properties at high temperatures.

According to one aspect of the present invention, there is provided a TiAl intermetallic compound-base alloy material having excellent strength properties at high temperatures, characterized by comprising: a fine alumina ($Al_2O_3$) dispersed to give an $O_2$ concentration of 1000 to 5000 ppm by weight and in a particle diameter of 200 to 500 nm; and TiAl having a Ti content of 50 to 53 at % and an Al content of 47 to 50 at %, or further comprising at least one of Cr, Mn, and V in an amount of 1 to 3 at % and TiAl.

According to another aspect of the present invention, there is provided a TiAl intermetallic compound-base alloy material having excellent strength properties at high temperatures and ductility, characterized by comprising: a dispersed fine alumina ($Al_2O_3$); and a boride ($TiB_2$) dispersed to give a B concentration of 0.1 to 10 at % and in a particle diameter of not more than 500 nm; or further comprising 1 to 3 at % of at least one of Cr, Mn, and V; more preferably, said TiAl intermetallic compound-base alloy material having been directly cast at a cooling rate of $10^3$ to $10^{5}$° C./sec.

According to a further aspect of the present invention, there is provided a process for producing a TiAl intermetallic compound-base alloy material having excellent strength and ductility at room temperature and high temperatures, characterized in that a fine $TiB_2$ having a diameter of not more than 500 nm is previously dispersed in the preparation of a master alloy by a melt process, a calcia crucible or an alumina ($Al_2O_3$) crucible coated with a calcia (CaO) powder is used as a crucible in high-frequency melting in the melting of the master alloy, a Ti plate is heated to 800 to 1100° C. in a VIM (vacuum induction melting) vessel to conduct gettering of oxygen present within the vessel, thereby lowering the concentration of oxygen in the atmosphere to not more than 0.2%, casting is carried out in this state to produce an ingot, and the ingot is ground and used as a raw material for mechanical alloying to prepare a powder which is then sintered and molded, or alternatively the ingot is subjected to isothermal forging to bring the structure to a fine grain structure.

According to a further aspect of the present invention, there is provided a process for producing a TiAl intermetallic compound-base alloy foil, characterized in that the TiAl intermetallic compound-base alloy sheet produced by the above process is molded by high-temperature pack rolling wherein an alumina foil or a calcia powder is used as a release material and packing is carried out using a Ti alloy or stainless steel.

BEST MODE FOR CARRYING OUT THE INVENTION

Figure 1:
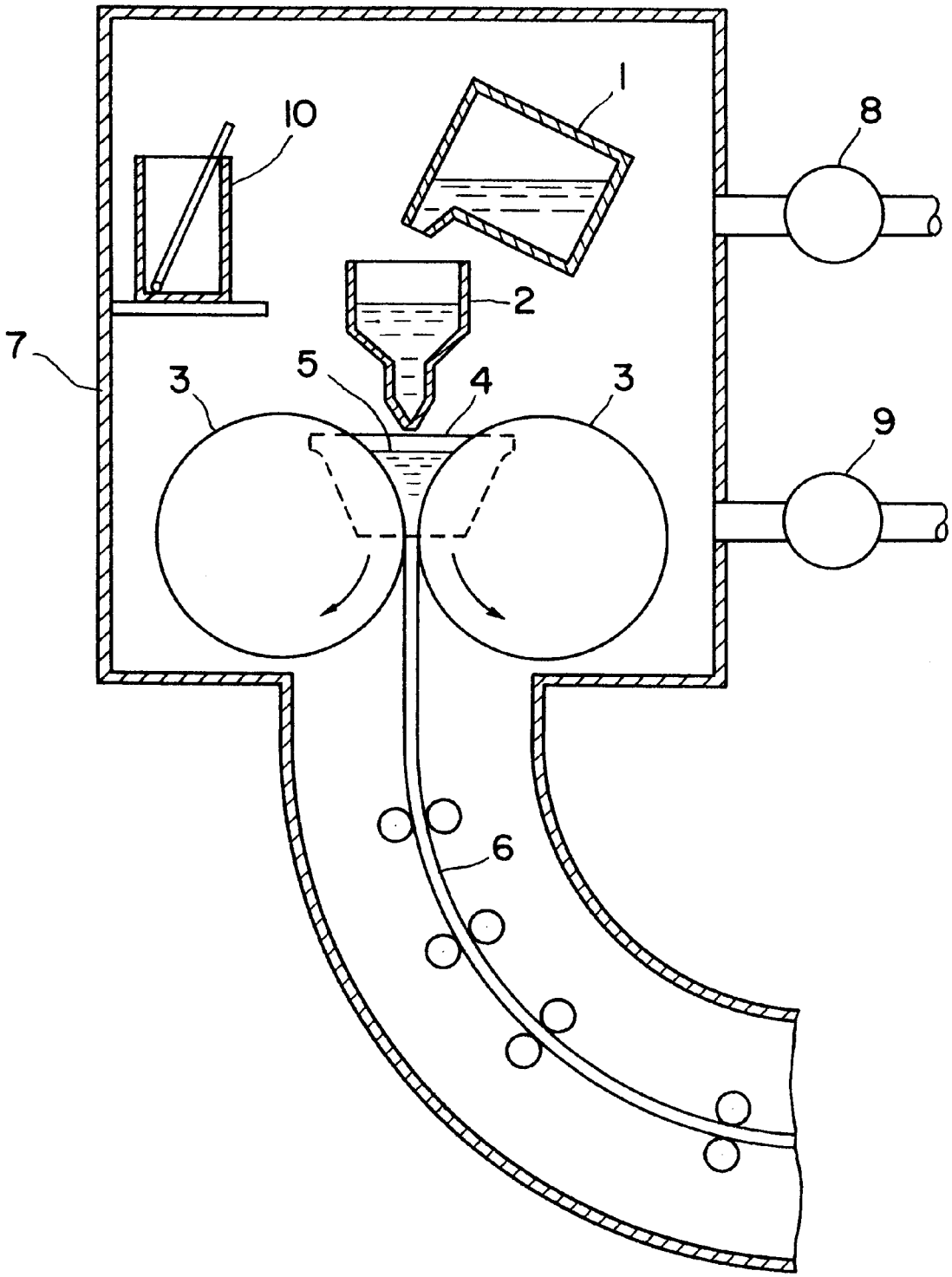
FIG. 1 is a schematic cross-sectional side view of a direct casting machine, for producing a sheet, used in practicing the present invention.

The present inventors have found that, in the matrix of the conventional TiAl intermetallic compound-base alloy, high strength at high temperatures can be provided by dispersing a fine oxide $Al_2O_3$ having a particle diameter of not more than 500 nm at intervals of not more than 10 $\mu$m in the matrix.

Further, the present inventors have found that the dispersion of a boride ($TiB_2$) in combination with the fine oxide in the matrix of the TiAl intermetallic compound-base alloy enables the ductility at room temperature to be ensured while maintaining the high strength at high temperatures attained by the dispersion of $Al_2O_3$ alone.

Specifically, despite the improvement in ductility at room temperature by refinement, a marked improvement in strength at high temperatures could be attained without a lowering in strength caused by promotion of grain boundary sliding expected by grain refining at high temperatures.

The mechanism through which the strength at high temperatures is developed will be described.

For alloy materials, the strength development temperature region is generally recognized to be up to a temperature obtained by multiplying the melting point, in terms of absolute temperature, of the material by 0.6. In temperatures above this value, the diffusion becomes dominant, and the material is viscously deformed at a lower stress than the yield point. That is, the deformation is mainly creep deformation.

In the case of binary system, TiAl has a melting point of 1470° C. Therefore, the melting point in terms of absolute temperature is 1743K, and the value obtained by multiplying this absolute temperature value by 0.6 is 1046K. That is, the upper limit of the strength development temperature is 772° C. when the temperature is above 772° C., grain boundary sliding and dislocation slip are activated, resulting in lowered yield stress and lowered strength. For TiAl intermetallic compound-base alloys, which have been subjected to conventional heat treatment or isothermal forging, the strength was 180 to 300 MPa at 800° C., 80 to 150 MPa at 1000° C., and not more than 40 MPa at 1100° C.

By contrast, the material, of the present invention, having a matrix with a fine oxide $Al_2O_3$ being dispersed alone or in combination with $TiB_2$ has improved yield stress and strength. The reason for this is considered as follows.

At the outset, regarding the grain boundary sliding, the presence of the fine oxide in the grain boundaries increases the stability of grains at high temperatures and causes the grain boundaries to be pinned, resulting in improved strength. On the other hand, in the case of transgranular sliding, the dislocation is accumulated in the transgranular fine oxide, inhibiting further movement caused by dislocation, resulting in increased strength. Further, since the propagation of dislocation is inhibited in this way, an intensive increase in dislocation density, which is the drive force for recrystallization, is reduced preventing a lowering in strength caused by dynamic recrystallization. These mechanisms can be explained by the fact that $Al_2O_3$ fine oxide dispersed alone or $Al_2O_3$ fine oxide and $TiB_2$ dispersed in combination can in itself function as fine inclusions.

Another important mechanism is strengthening by dissolution of oxygen in a solid solution form in an $\alpha_2$ phase constituting the lamellar structure of TiAl. The $\alpha_2$ phase functions as a getter of oxygen in TiAl. In the lamellar structure, in TiAl, constituted by $\gamma$ phase and $\alpha_2$ phase, the space between phases is small particularly in $\alpha_2$ in the second phase and about 10 nm. For this reason, the determination of the concentration of oxygen contained in this phase has been difficult. However, the quantification of the oxygen concentration has become possible by using a high-oxygen (1.5 wt %) material, facilitating the identification of oxygen, and using as analyzing means AP-FIM analysis which enables the determination of area and the quantitative analysis on the order of atom. As a result, it has been found that most of the oxygen is absorbed in the $\alpha_2$ phase, and the amount of the oxygen in a solid solution form in the $\alpha_2$ phase is on a level of 5 at % (R. Uemori, T. Hanamura and H. Morikawa, Scripta Metall. Mater., 26, 1992, 969).

Thereafter, a confirmative experiment using AP-FIM was conducted by a French researcher, making it possible to perform the determination of oxygen concentration on a ppm level (A. Huguet and A. Menand, Applied Science, 76/77, 1994, 191). According to this determination, the upper limit of the amount of oxygen dissolved in a solid solution form in the γ phase is 300 wt. ppm, and most of the oxygen is dissolved in a solid solution form in the $\alpha_2$ phase. The upper limit of the amount of oxygen dissolved in a solid solution form in the $\alpha_2$ phase is estimated to be 5 at %.

From the above facts, it is considered that oxygen other than that in $Al_2O_3$ is present in the $\alpha_2$ phase and contributes to solid solution strengthening of the $\alpha_2$ phase. Further, in a Ti alloy, oxygen is generally known as an α phase stabilizing element. Therefore, it is considered that the dissolution of oxygen in the $\alpha_2$ phase enhances the stability of the α2 phase at high temperatures, contributing to the strength at high temperatures. This leads to the inhibition of dynamic recrystallization.

As described above, it is considered that the strength at high temperatures can be attained by synergistic effect of the inhibition of grain boundary sliding, the inhibition of transgranular sliding, and the inhibition of dynamic recrystallization.

The mechanism for fine particle dispersion strengthening attained by the fine oxide alone will be discussed using the Ashby's equation.

At the outset, parameters are set as follows.

R: Radius of fine oxide $\mu$: Elastic constant of γTiAl l: Average distance between particles of fine oxide f: Volume fraction of fine oxide b: Burgers vector of dislocation in γTiAl M: Poisson constant σ: Strength (stress)

τ: Strength (shear stress)

When the volume of the fine oxide is first taken into consideration, the following relational expression is established.

$$2Rl^2 f = \frac{4}{3}\pi R^3 \tag{1}$$

Thus, $$l^2 = \frac{4\pi R^2}{3\cdot 2f} \tag{2}$$

$$\therefore l = \frac{(2\pi)^{1/2} R}{(3f)^{1/2}} \tag{3}$$

The shear stress can be expressed as follows.

$$\tau = \frac{\mu b}{l} \tag{4}$$

Therefore, the shear stress created by dispersion of the fine oxide is:

$$\tau_0 = \frac{\mu b(3f)^{1/2}}{(2\pi)^{1/2} R} \tag{5}$$

From this, the strength (stress) by the dispersion of the fine oxide is:

$$\sigma = \frac{M\mu b(3f)^{1/2}}{(2\pi)^{1/2} R} \tag{6}$$

Next, the parameters are set at the following respective values.

M=3, $\mu$=5×10$^{10}$ Pa, b=0.25 nm, R=200 nm, and f =0.1% to $10^{-3}$.

The substitution of these values for the equation (6) gives:

$$\sigma = \frac{3\times 5\times 10^{10}\times 2.5\times 10^{-10}\times\left(\frac{1}{2000}\right)^{1/2}}{2000\times 10^{-10}}$$
$$\sim 4\times 10^6 \text{ Pa}$$
$$= 4 \text{ MPa}$$

Thus, according to the estimation from he Ashby logical expression, it is concluded that the increase in strength by contribution of the dispersion of the fine oxide alone is very small, i.e., on a level of 4 MPa at the largest. From the results of the calculation, it can be said that the reason why the actual high-temperature strength at 1100° C. could be improved from the conventional level 40 MPa to the level of 220 MPa cannot be satisfactorily explained by mere dispersion of the fine oxidation alone. After all, this improvement is considered to be attained by the synergistic effect of the dispersion of the fine oxide, the solid solution strengthening of oxygen in the $\alpha_2$ phase in the fine lamella, and the matching between the lamella and the fine oxide. In the synergistic effect, it is considered that, in particular, a smaller distance between fine lamellae and, further, a better coincidence between the size of the fine oxide and the space between fine lamellae offer higher contribution of lamella interface matching, resulting in higher strength at high temperatures.

The increase in strength by the reduction in the space between the lamellae is supported, for example, by the results of an experiment using TiAl polysynthetic-twin results conducted by Umakoshi et al. (Y. Umakoshi, T. Nakano and T. Yamane, Mat. Sci. and Eng., A152, 1992, 81). This article substantiates that the space between lamellae exhibits Hall Petch's relation with respect to the strength.

In the present invention, in order to attain the strength at high temperatures, the particle diameter of finely dispersed $Al_2O_3$ should be not more than 500 mn. The lower limit of the particle diameter is 100 nm, preferably 200 nm. This is because when the particle diameter is less than 100 nm, the interaction between the particles and the dislocation is so small that the inhibition of transgranular sliding or the like is unsatisfactory. On the other hand, when the particle diameter is excessively large and exceeds 500 nm, the particles serve as the origin of cracking, resulting in deteriorated ductility.

The oxygen concentration for providing $Al_2O_3$ having the above particle diameter range is 1000 to 5000 ppm by weight, preferably 1000 to 4000 ppm by weight, more preferably 1000 to 2500 ppm by weight. The reason for this is as follows. When the oxygen concentration is less than 1000 ppm by weight, the amount of the oxide is so small that no satisfactory strength at high temperatures can be provided. On the other hand, when it exceeds 5000 ppm by weight, the $Al_2O_3$ is coarsened and functions as the origin of cracking, resulting in deteriorated ductility and toughness.

At least one of Cr, Mn, and V may be added, as an additive element, in a total amount of not more than 3 at % to the TiAl intermetallic compound-base alloy material according to the present invention. Cr, Mn, and V, when isothermal forging of the material is added, function to refine the structure and to precipitate a β phase in γ grain boundaries, enhancing superplasticity at high temperatures and thus improving the ductility at high temperatures.

In general, the refinement of the structure can improve the strength and ductility at room temperature. In this case, however, fine grains promote grain boundary sliding, resulting in deteriorated strength at high temperatures. In the material of the present invention, however, by virtue of the dispersion of the fine oxide and the addition of $TiB_2$, the ductility at high temperatures and the ductility at room temperature can be improved by 2% or more without rapidly deteriorating the strength at high temperatures.

Uniform refinement of the structure is important to the enhancement of the ductility at room temperature of the TiAl intermetallic compound-base alloy material. For attaining this purpose, isothermal forging at a low strain rate in a high temperature region around 1200° C. has been necessary in the prior art. In a usual casting structure, for example, in a two-component system having a composition of Ti: 50 at % and Al: 50 at %, grains in the as-cast structure are greatly coarsened to a diameter of about 2 mm. Further, a TiAl intermetallic compound-base alloy sheet produced by direct sheet casting has a problem that the thickness of the as-cast material is as small as 1.5 mm, making it impossible to conduct pressing with a reduction ratio of about 80% by isothermal forging which is necessary for the regulation of the structure.

By contrast, according to the present invention, even fine grains having a diameter of 20 μm could be provided in the as-cast state. The mechanism through which the ductility at room temperature is developed will be described.

Fine grains of alumina first functions as a nucleation site for the refinement of grains. When alumina is used alone, the growth of grains with the alumina functioning as the nucleation site is not easy. For this reason, another precipitation phase, which, together with the grains, precipitates on the alumina is used. Preferably, this precipitation phase is present in a melted state in the molten TiAl intermetallic compound-base alloy and precipitates in a matched manner on the alumina upon solidification of the TiAl intermetallic compound-base alloy. The precipitation reduces elements constituting the precipitate around the alumina. This shortens the latent period for nucleation in a localized area around the alumina, creating nucleation of grains. When a large number of alumina particles are finely dispersed in advance, the nucleation of grains occurs simultaneously in many areas, creating a structure of fine grains.

An experiment was conducted using $TiB_2$ as a precipitate which matches both the alumina and the γTiAl phase. As a result, a structure of uniform fine grains having a size of 100 μm could be provided by the conventional high frequency melting (VIM melting) and the conventional ingot casting.

The combined use of the above effect and supercooling effect is more effective in attaining further refinement of the structure. Rapid cooling may be utilized for this purpose. Twin-roll direct casting of a TiAl master alloy with $TiB_2$ dispersed therein enabled the grain diameter to be regulated to 20 μm. By virtue of the fine uniform structure, a tensile ductility at room temperature of 2.12% could be provided by twin-roll casting (without any subsequent treatment) +HIP (high temperature isostatic pressure) treatment +stress relieving annealing at 1000° C.

According to the present invention, in the melting of the alloy, an alumina ($Al_2O_3$) crucible coated with a calcia (CaO) powder is used as the crucible used in the high frequency melting to prevent inclusion of contaminants, such as oxygen, from the crucible. This is because the thermodynamic stability of calcia is better than that of alumina. More specifically, alumina is reduced by a reaction with Ti as a raw material, whereas calcia hardly reacts with Ti.

In the present invention, a Ti plate is heated to around 1000° C. within a vessel in a twin-roll casting system to conduct gettering of oxygen within the vessel, thereby lowering the concentration of oxygen in the atmosphere. In this case, the oxygen concentration of the atmosphere should be lowered to not more than 200 ppm. Preferably, it is lowered to not more than 100 ppm. The lowering in the oxygen concentration of the atmosphere to not more than 100 ppm in combination with the coating of the crucible enables the concentration of oxygen in the cast material to be directly lowered to not more than 0.25% by weight. This offers optimal control of the alumina oxide in the matrix. Even when the concentration of oxygen in the atmosphere is not more than 200 ppm, the oxide can be controlled.

In the present invention, the alumina oxide can be dispersed as fine particles having a diameter of not more than 500 nm. This is because the molten metal is always in the state of agitation by strong convection created by high frequency during melting of the parent material by high frequency melting and this state is frozen by twin-roll direct casting. In this case, freezing refers to a solidified state with the dispersion of the oxide at high temperatures being maintained. This can inhibit coarsening caused by aggregation of the oxide.

In general, the alumina oxide is likely to be coarsened by aggregation. In the case of oxygen concentration 1.5 wt %, in the state of a usual cast ingot, the alumina oxide is unfavorably coarsened to a diameter of 50 μm. Freezing by means of a twin roll alone leads to coarsening to a diameter of 2 to 3 μm. By contrast, according to the present invention, the combination of the low oxygen concentration 0.25 wt % with the twin roll process can realize dispersion of fine oxide particles having a diameter of not more than 500 nm.

In the present invention, the addition of $TiB_2$ necessary for the refinement of the structure is performed by introducing the $TiB_2$ wrapped in a Ti foil into a molten metal 2 to 3 min before pouring into a mold in the preparation of a master alloy by the VIM process. This shortens the residence time in the molten metal, preventing the aggregation of $TiB_2$.

EXAMPLES

The present invention will be described with reference to the following examples and comparative examples.

At the outset, one embodiment of a machine for the production of a sheet by direct casting used in the present invention will be described with reference to FIG. 1. In FIG. 1, a tundish 2 for evenly supplying a molten metal is disposed below a crucible 1 for melting an intermetallic compound, and a pouring basin 5 (mold) constituted by a cooling drum 3 and a side dam 4 is provided just under the tundish 2. All of them are provided within an atmosphere controller 7. Numeral 8 designates an inert gas introduction mechanism, and numeral 9 designates an exhaust mechanism.

EXAMPLE 1

An aluminum metal and a sponge titanium were mixed together to give a composition of Ti: 50 at % and Al: 50 at %, and the mixture was melted in an alumina ($Al_2O_3$) crucible coated with a calcia (CaO) powder by high-frequency melting (VIM), whereby a master alloy was prepared by a melt process. The crucible had a size of 110 (inner diameter)×125 (outer diameter)×180 (height) mm. The high-frequency melting was conducted under conditions of voltage: 62 V, current: 76 A, and power: 10 kW for the first 10 min and then under conditions of voltage: 75 V, current: 80 A, and power: 20 kW for the last 20 min.

The master alloy was taken off in a weight range of from 2000 to 3500 g and placed in the above crucible. The vessel was hermetically sealed and evacuated, and the atmosphere was replaced with Ar gas.

In the Ar atmosphere, a Ti plate was heated to around 1000° C. in a vessel of a twin-roll casting system to conduct gettering of oxygen present within the vessel, thereby lowering the oxygen concentration of the atmosphere. In this case, the concentration of oxygen in the vessel of the twin-roll casting system was continuously monitored with an oxygen analyzer. The oxygen concentration before gettering was 1%, whereas the gettering could lowered the oxygen concentration to not more than 0.2%. Heating of the getter at 1000° C. was continued until the production of the twin-roll sheet was completed.

The master alloy was then heat-melted in the above Ar atmosphere and adjusted to a temperature of 1600° C. and poured into a pouring basin 5 through a tundish with an opening having a width of 4 mm and a length of 95 mm. The cooling drum 3 constituting the pouring basin 5 comprised a pair of drums which had a diameter of 300 mm and a width of 100 mm and were made of a copper alloy and internally cooled. The molten metal was rapidly solidified at a cooling rate of $10^{3°}$ C./sec with the drum supporting force being kept constant, thereby preparing a continuous cast strip in a sheet form. In this case, the sheet thickness was regulated to 1.5 mm by setting the twin roll nip (1.5 mm), the rotational speed of rolls (0.44 m/sec), and the temperature of the molten metal at the time of tilting thereof (1600° C.).

The cast strip 6 delivered from the cooling drum 3 was inserted into a carrier vessel while gradual cooling at a rate of 1° C./sec within the atmosphere control vessel 7.

In the structure in section, in the direction of casting, of the cast strip thus obtained, the as-cast solidification structure comprised only a columnar crystal extending from both surfaces of the cast strip toward the center portion thereof or comprised a mixture of the above columnar crystal with an equiaxed crystal present around the center portion of the cast strip.

Figure 2:
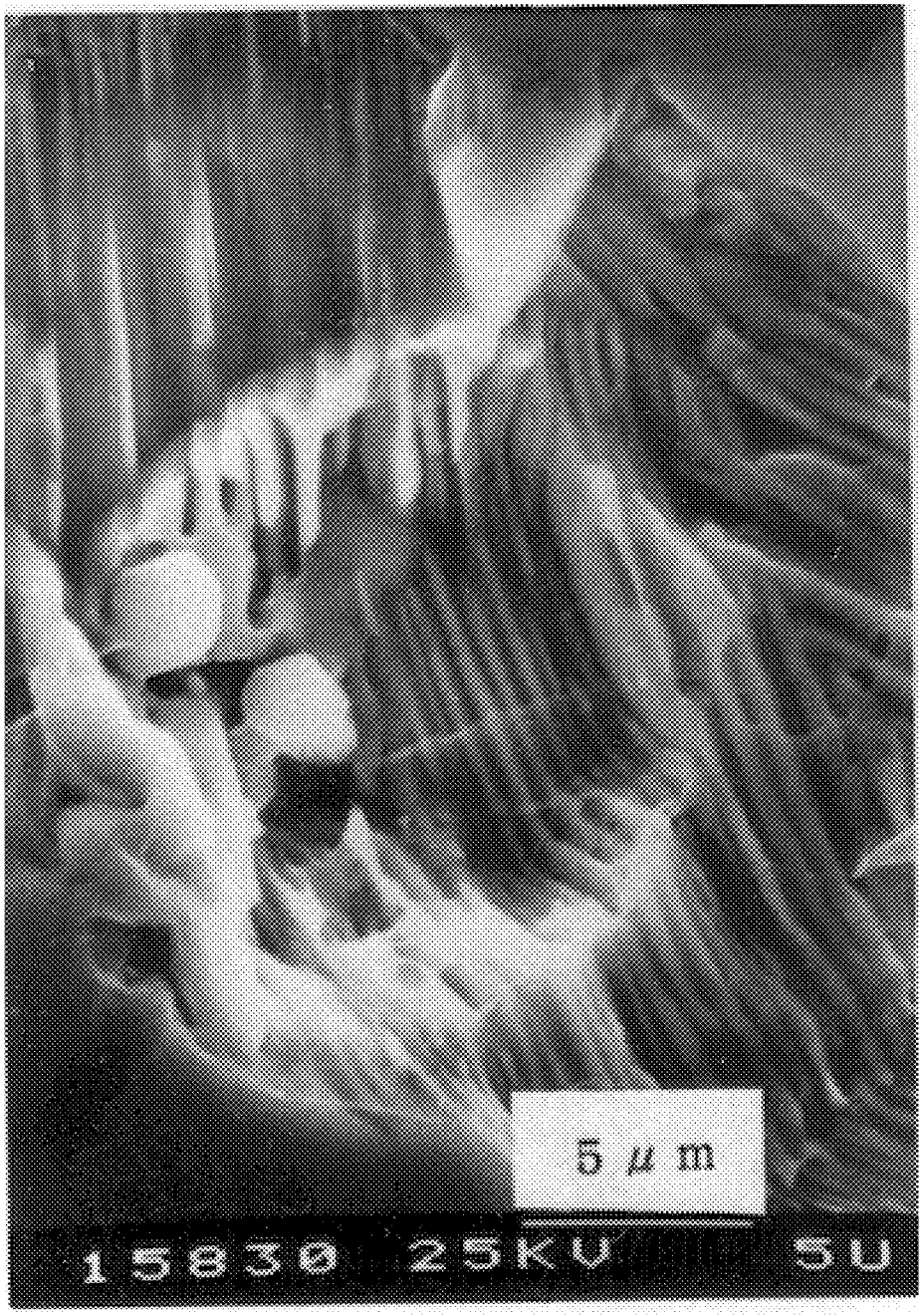
FIG. 2 is a photograph showing the crystal structure of alumina in a material (oxygen concentration 1.5 wt %) according to the present invention.
Figure 3:
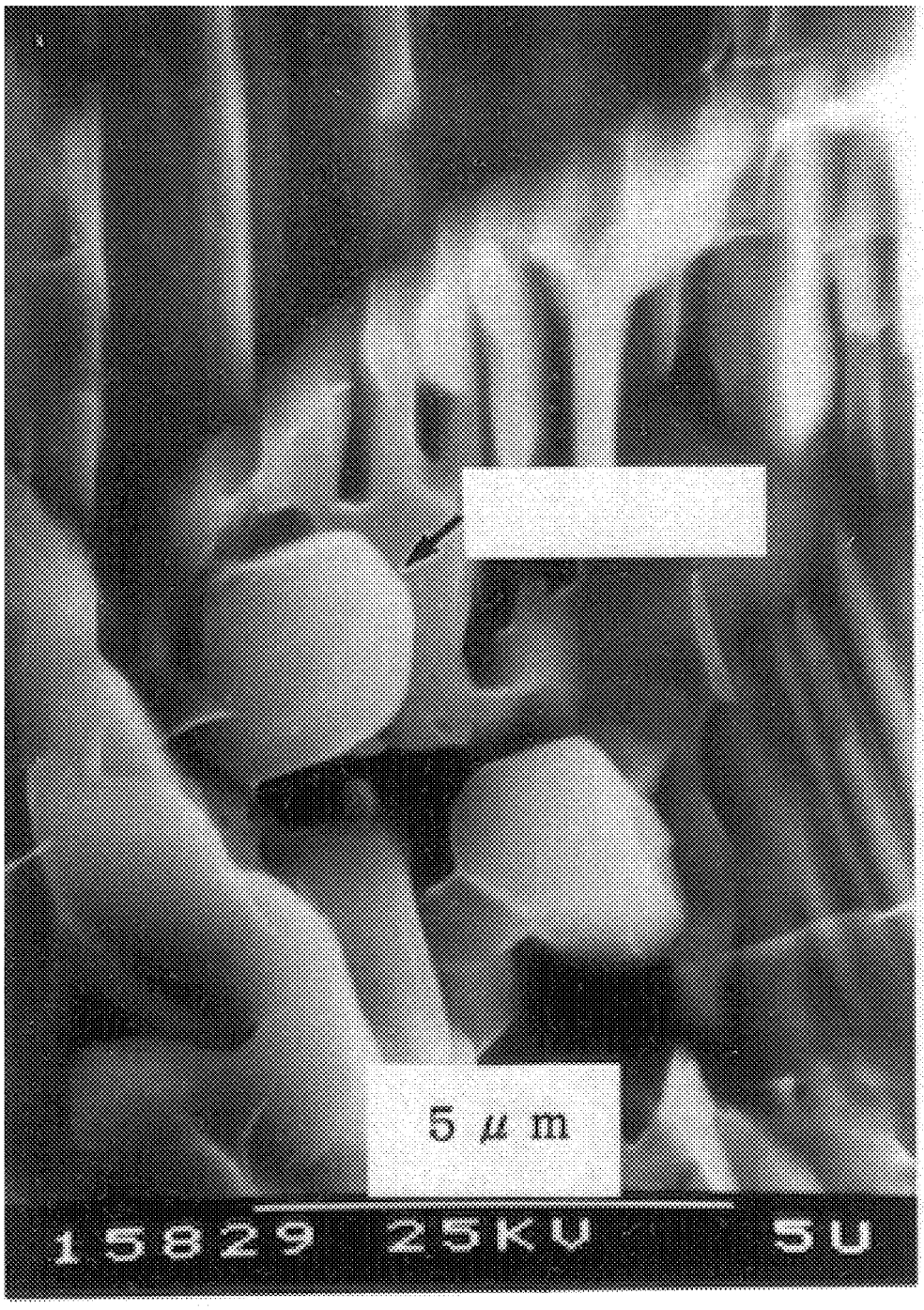
FIG. 3 is an enlarged view of the photograph shown in FIG. 2.
Figure 4:
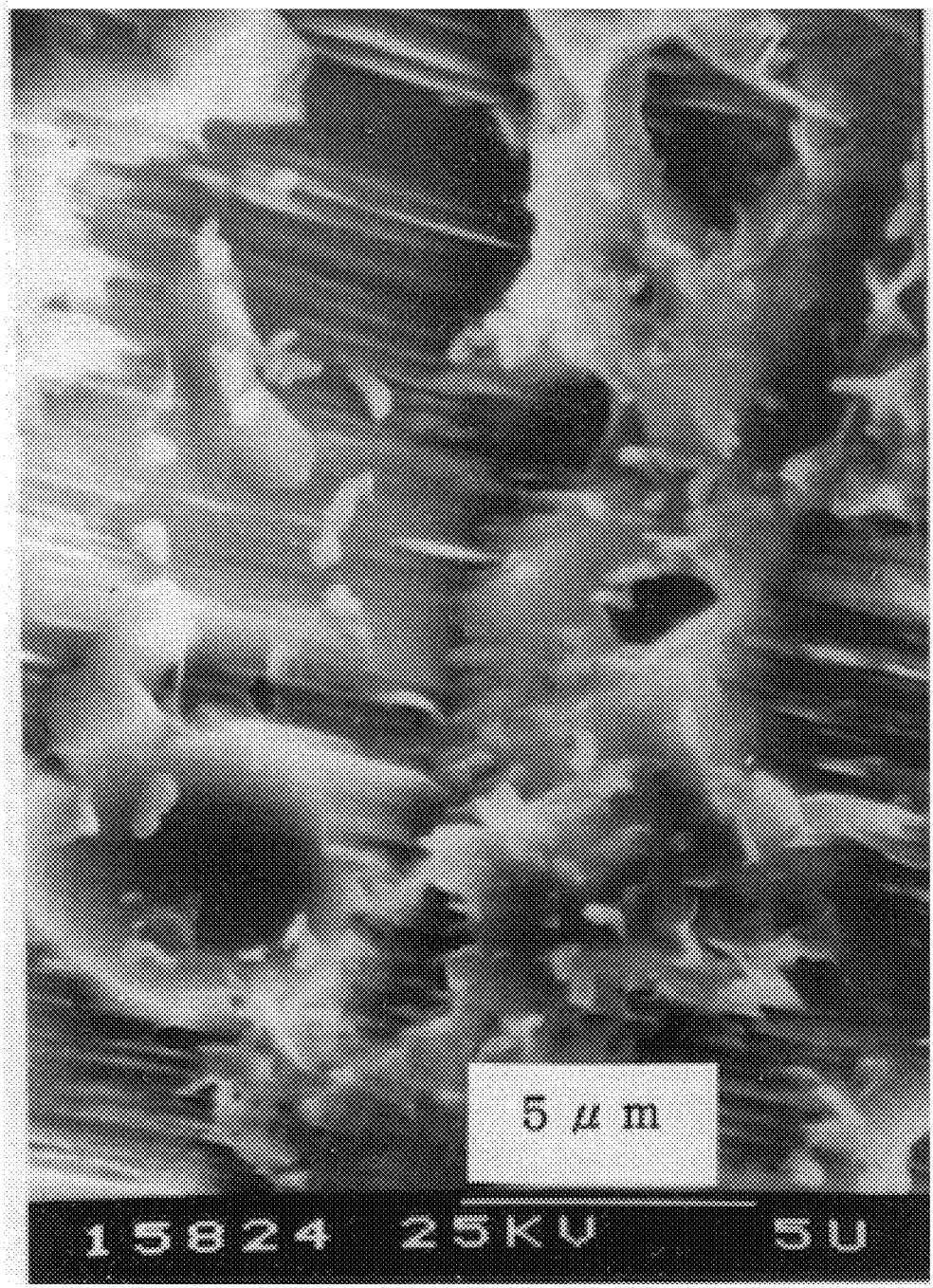
FIG. 4 is a photograph showing the crystal structure of alumina in a material (oxygen concentration 0.25 wt. %) according to the present invention.
Figure 5:
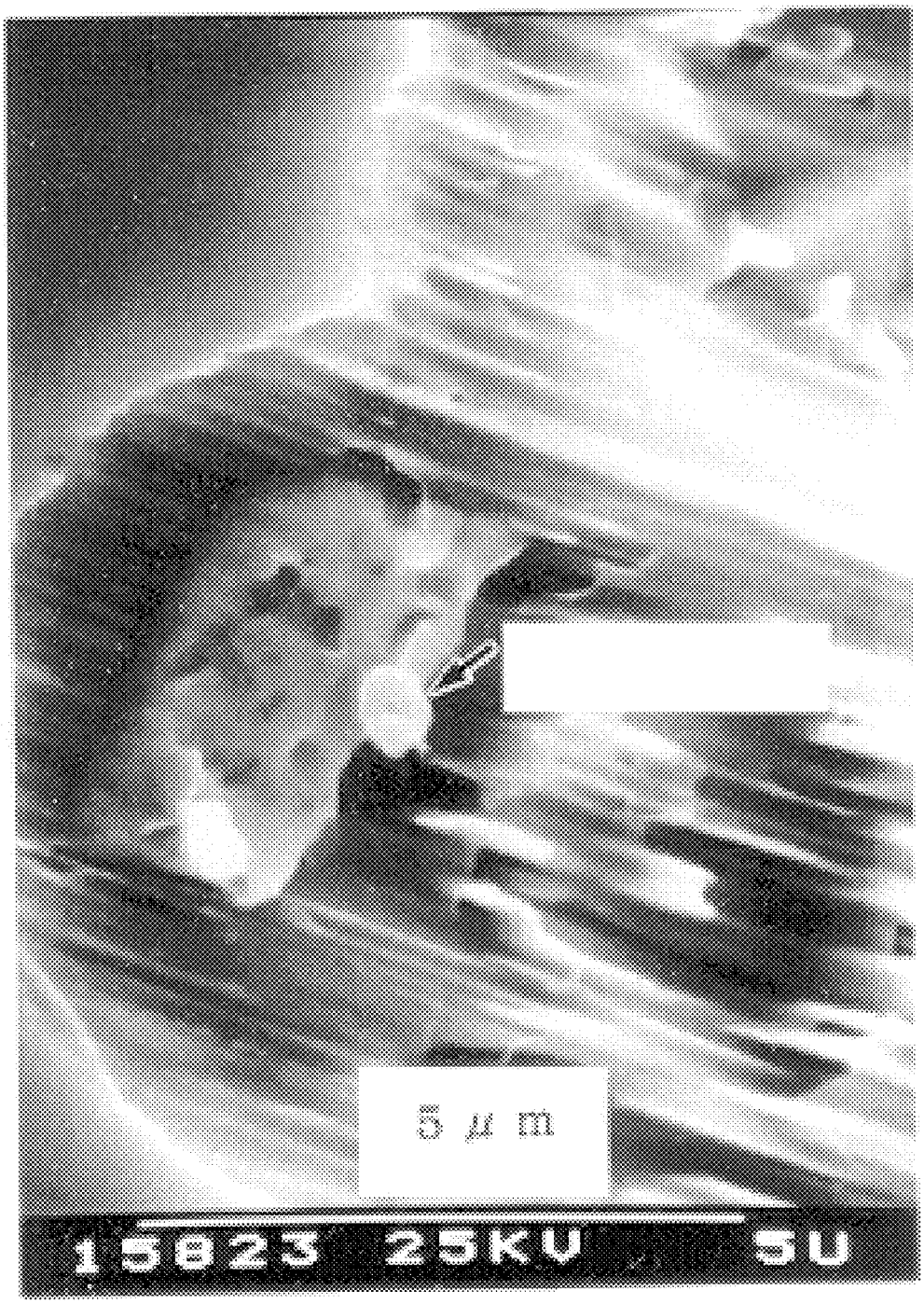
FIG. 5 is an enlarged view of the photograph shown in FIG. 4.

As shown in FIGS. 2 to 5, in the microstructure of the cast strip prepared according to the present invention, $Al_2O_3$ having a diameter of not more than 500 nm is finely dispersed. FIG. 2 shows the crystal structure of alumina in a material (oxygen concentration 1.5 wt %). FIG. 3 is an enlarged view of the crystal structure shown in FIG. 2. FIG. 4 shows the crystal structure of alumina in a material (oxygen concentration 0.25 wt %), and FIG. 5 is an enlarged view of the crystal structure shown in FIG. 4.

EXAMPLE 2

An aluminum metal and a sponge titanium were melted in an alumina ($Al_2O_3$) crucible coated with a calcia (CaO) powder by high-frequency melting (VIM), and Cr was added as an additive element. Thus, a master alloy of Ti-47Al-3Cr was prepared by a melt process. The procedure of Example 1 was then repeated. That is, twin-roll casting of a sheet was carried out, and a cast strip was prepared therefrom by high-temperature hot isostatic pressing (HIP).

Mechanical properties at high temperatures of the cast strip thus obtained are tabulated in Table 1. The test on the mechanical properties were carried out under conditions of vacuum of test atmosphere $5\times10^{-5}$ Torr and strain rate $7.2\times10^{-4}$ $sec^{-1}$.

TABLE 1

| High-temp. tensile properties (Example 2) | | | |
|---|---|---|---|
| Test temp. (° C.) | Yield stress (MPa) | Tensile strength (MPa) | Ductility (%) |
| 800 | 389 | 579 | 13.2 |
| 1000 | 316 | 385 | 26.5 |
| 1100 | 179 | 226 | 49.3 |

Figure 6:
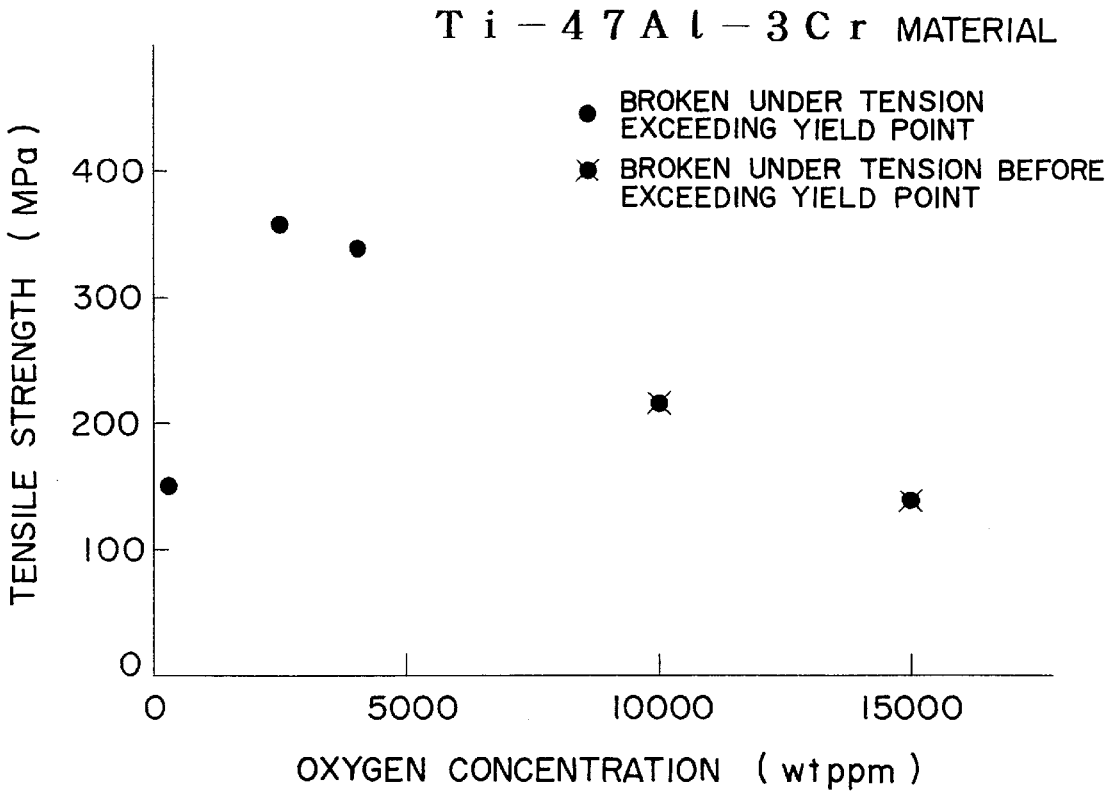
FIG. 6 is a graph showing the relationship between the oxygen concentration (ppm) and the tensile strength (MPa) at 1000° C. for a Ti-47Al-3Cr material (at %) which is a material of the present invention.

The influence of the oxygen concentration on the tensile strength at 1000° C. for the Ti-47Al-3Cr material is shown in FIG. 6. As can be seen from FIG. 6, the upper limit of the oxygen concentration in the present invention is not more than 5000 ppm by weight, preferably not more than 4000 ppm by weight.

COMPARATIVE EXAMPLES 1 to 5

For comparison, conventional TiAl alloy materials as shown in Table 2, that is, a plasma-melted, annealed material, an isothermally formed material, and commercially available superalloys were provided.

TABLE 2

| Composition and working and heat treatment conditions for samples | | | |
|---|---|---|---|
| | | Composition (at %) | Working and heat treatment |
| Example | 1 | Ti-50Al | Twin-roll casting of sheet + HIP |
| | 2 | Ti-47Al-3Cr | Twin-roll casting of sheet + HIP |
| | 1 | Ti-47Al-3Cr | Plasma melting + annealing |
| | 2 | Ti-47Al-3Cr | Plasma melting + isothermal forging |
| Comp. Ex. | 3 | Ti-50Al | Plasma melting + isothermal forging |
| | 4 | Co-base superalloy | Commercially available material |
| | 5 | Ni-base superalloy | Commercially available material |

Figure 7:
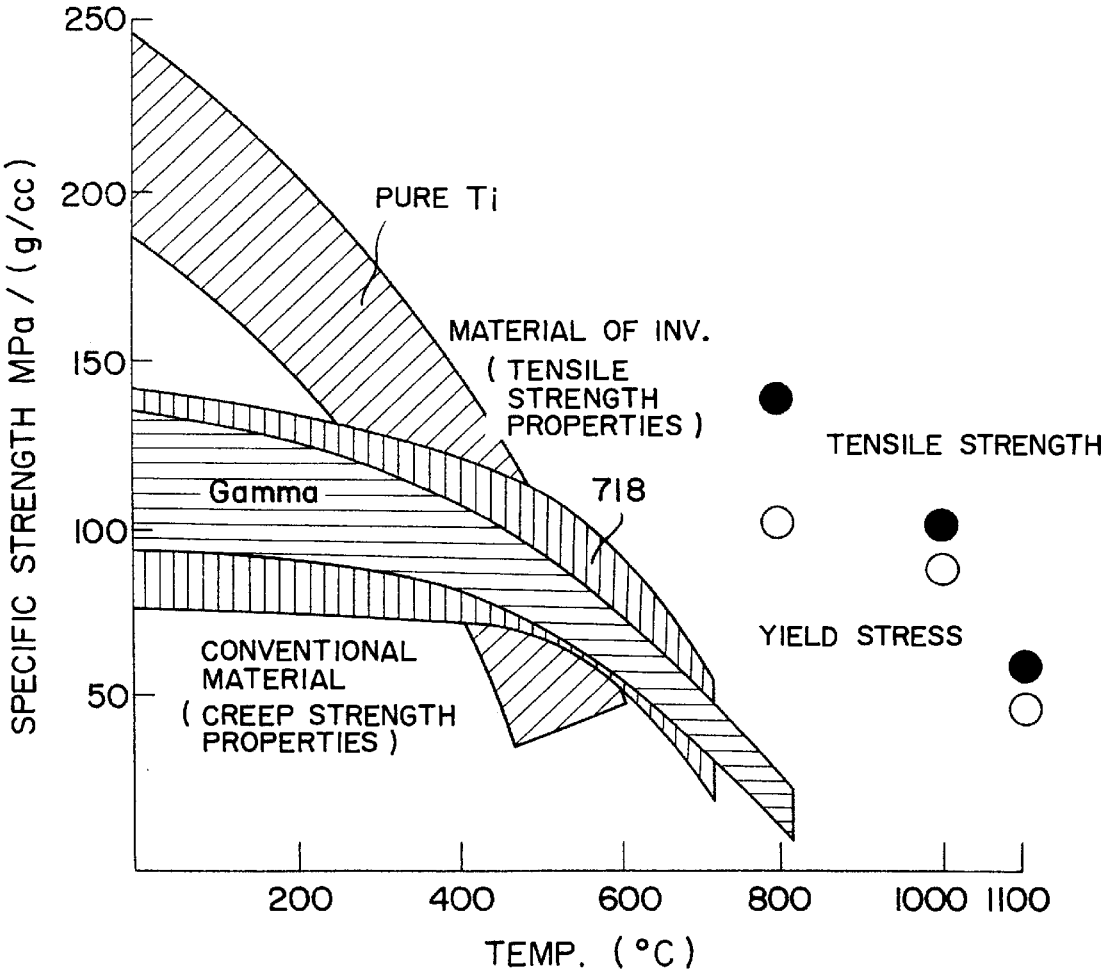
FIG. 7 is a graph showing a comparison between the specific strength of a Ti-47Al-3Cr material, a material of the present invention, and that of pure Ti, a Ti alloy, and a conventional TiAl alloy.

Next, the high-temperature properties of the TiAl intermetallic compound-base alloy material according to the present invention were compared with those of the conventional material. For both materials, the relationship between the specific strength and the temperature is shown in FIG. 7. From data shown in FIG. 7, it can be said that the material of the present invention has the highest strength as the alloy system in the high-temperature specific strength properties.

According to the present invention, the cast strip and the treated sheet had markedly improved mechanical properties. This improvement is considered to derive from the fact that a reduction in inclusion of impurities resulted in a reduction in oxygen concentration of the material, offering an optimal oxygen content. Further, agitation by high frequency finely divided the oxide, and this state could be frozen by direct twin-roll casting.

EXAMPLES 3 to 5

An aluminum metal and a sponge titanium were mixed together to give a composition of Ti: 50 at % and Al: 50 at %, and the mixture was melted by high-frequency melting (VIM), whereby a master alloy was prepared by a melt process. In this case, in the final stage of pouring of the molten metal, a $TiB_2$ powder, in an amount corresponding to 1 at %, wrapped in an Al foil was added to the molten metal, thereby dispersing the $TiB_2$ powder in the γTiAl matrix.

Then, an alumina ($Al_2O_3$) crucible coated with a calcia (CaO) powder was provided as a crucible used in high-frequency melting before melting.

The master alloy was taken off in a weight range of from 2000 to 3500 g and placed in the above crucible. The vessel was hermetically sealed and evacuated, and the atmosphere was replaced with Ar gas.

In the Ar atmosphere, a Ti plate was heated to around 1000° C. in a vessel of a twin-roll casting system, and oxygen present within the vessel was subjected to gettering to lower the oxygen concentration of the atmosphere. In this case, the concentration of oxygen in the vessel of the twin-roll casting system was continuously monitored with an oxygen analyzer. The oxygen concentration before gettering was 1%, whereas the gettering could lowered the oxygen concentration to not more than 0.2%.

Heating of the getter at 1000° C. was continued until the production of the twin-roll sheet was completed.

The master alloy was then heat-melted in the above Ar atmosphere, adjusted to a temperature of 1700° C. and poured into a pouring basin 5 through a tundish with an opening having a width of 4 mm and a length of 95 mm. The cooling drum 3 constituting the pouring basin 5 comprised a pair of drums which had a diameter of 300 mm and a width of 100 mm and were made of a copper alloy and internally cooled. The molten metal was rapidly solidified at a cooling rate of $10^{3}$° C./sec with the drum supporting force being kept constant, thereby preparing a continuous cast strip in a sheet form. In this case, the sheet thickness was regulated to 1.5 mm by setting the twin roll nip (1.5 mm), the rotational speed of rolls (0.44 m/sec), and the temperature of the molten metal at the time of tilting thereof (1600° C.).

The cast strip 6 delivered from the cooling drum 3 was inserted into a carrier vessel while gradual cooling at a rate of 1° C./sec within the atmosphere control vessel 7.

Compositions of samples used as examples and working and heat treatment conditions are tabulated in Table 3.

TABLE 3

Compositions of samples and working and heat treatment conditions

| | | Composition (at %) | Working and heat treatment |
|---|---|---|---|
| Example | 3 | Ti-50Al-0.1$TiB_2$ | Twin-roll casting of sheet + HIP |
| | 4 | Ti-50Al-1$TiB_2$ | Twin-roll casting of sheet + HIP |
| | 5 | Ti-47Al-3Cr-1$TiB_2$ | Twin-roll casting of sheet + HIP |
| Comp. Ex. | 6 | Ti-50Al-0.1$TiB_2$ | High-frequency melting + isothermal forging |
| | 7 | Ti-50Al-1$TiB_2$ | High-frequency melting + isothermal forging |
| | 8 | Ti-47Al-3Cr | Plasma melting + annealing |
| | 9 | Ti-47Al-3Cr | Plasma melting + isothermal forging |

TABLE 3-continued

Compositions of samples and working and heat treatment conditions

| | Composition (at %) | Working and heat treatment |
|---|---|---|
| 10 | Ti-50Al | Plasma melting + isothermal forging |
| 11 | Co-base superalloy | Commercially available material |
| 12 | Ni-base superalloy | Commercially available material |
| 13 | Ti-50Al | Twin-roll casting of sheet + HIP |

The influence of the addition of $TiB_2$ on the refinement of the structure was observed. Optical photomicrographs of metallographic structures in section in the thicknesswise direction are shown in FIG. 8 for a comparative material with $TiB_2$ not added thereto (Comparative Example 10), in FIG. 9 for a material of the present invention with 0.1 at % $TiB_2$ added thereto (Example 3), and in FIG. 10 for a material of the present invention with 1 at % $TiB_2$ added thereto (Example 4).

Figure 8:
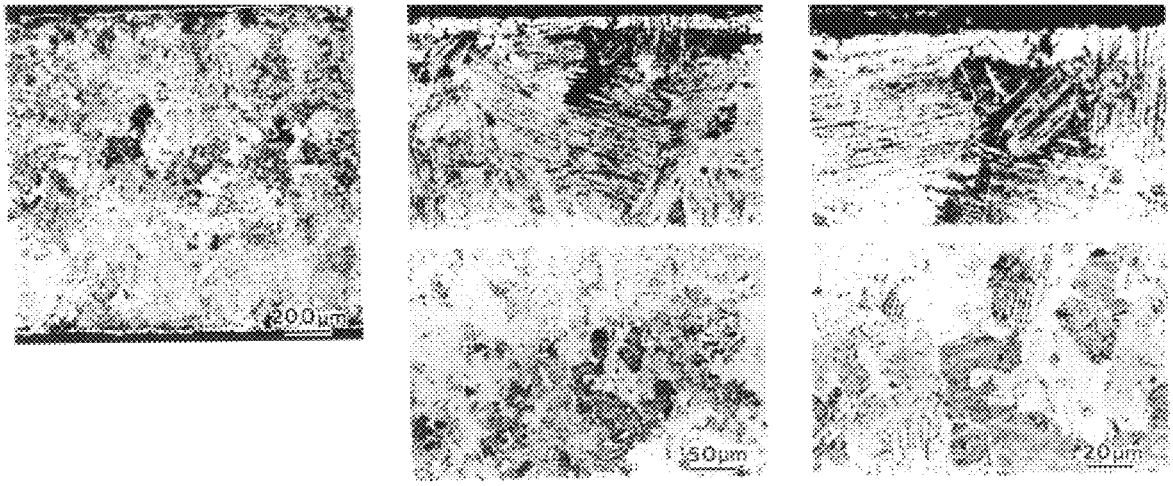
FIG. 8 is a metallographic photograph in section, in the thicknesswise direction, of a TiAl intermetallic compound-base alloy material with $TiB_2$ not added thereto.
Figure 9:
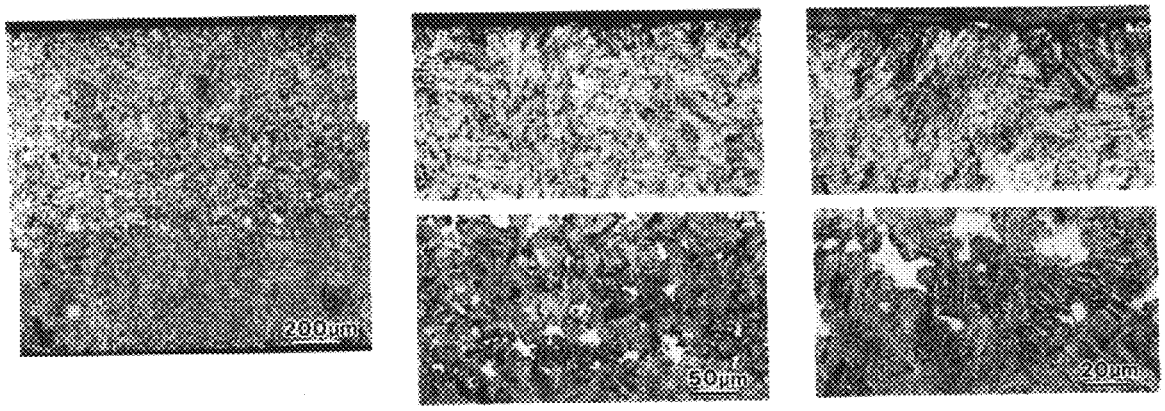
FIG. 9 is a metallographic photograph in section, in the thicknesswise direction, of a TiAl intermetallic compound-base alloy material with 0.1 at % $TiB_2$ added thereto.
Figure 10:
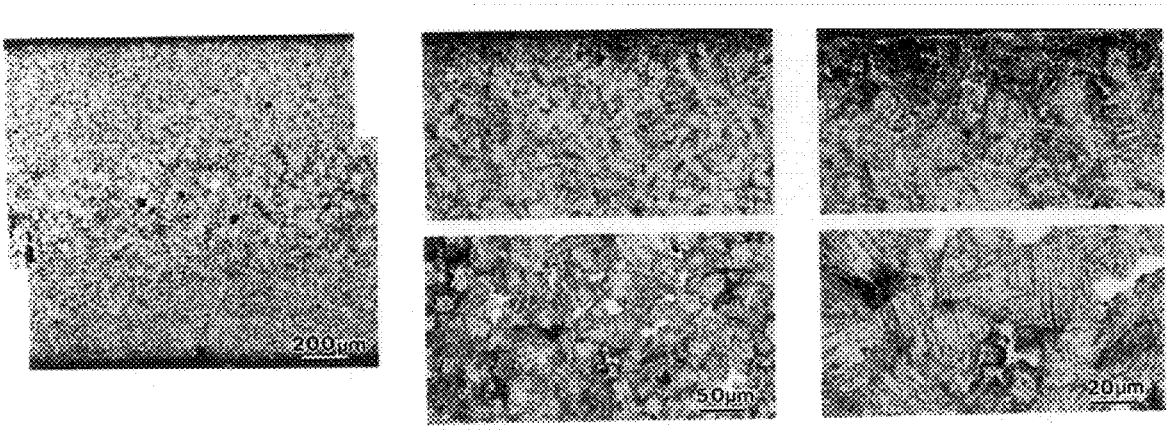
FIG. 10 is a metallographic photograph in section, in the thicknesswise direction, of a TiAl intermetallic compound-base alloy material with 1 at % $TiB_2$ added thereto.

All the photomicrographs shown in FIGS. 8 to 10 are in sets of five. The photomicrograph (1) located on the leftmost side is one showing the whole section, the photomicrograph (2) located in the center top portion is an enlarged photomicrograph of the surface of the sheet in the thicknesswise direction thereof, the photomicrograph (3) located on the center bottom is an enlarged photomicrograph in the center of the sheet in the thicknesswise direction thereof, the photomicrograph (4) located on the right top is an enlarged photomicrograph of (2), and the photomicrograph (5) located on the right bottom is an enlarged photomicrograph of (3).

As can be seen from FIGS. 8 to 10, the addition of $TiB_2$ results in marked refinement of the structure, and the addition of 1 at % $TiB_2$ brings the grain diameter to a level of 10 μm. For the 300 ppm oxygen material (50 at % Ti-50 at % Al) with $TiB_2$ not added thereto, which had not been rapidly cooled by the twin roll, the grain was coarsened to a large diameter of 2 mm.

Figure 11:
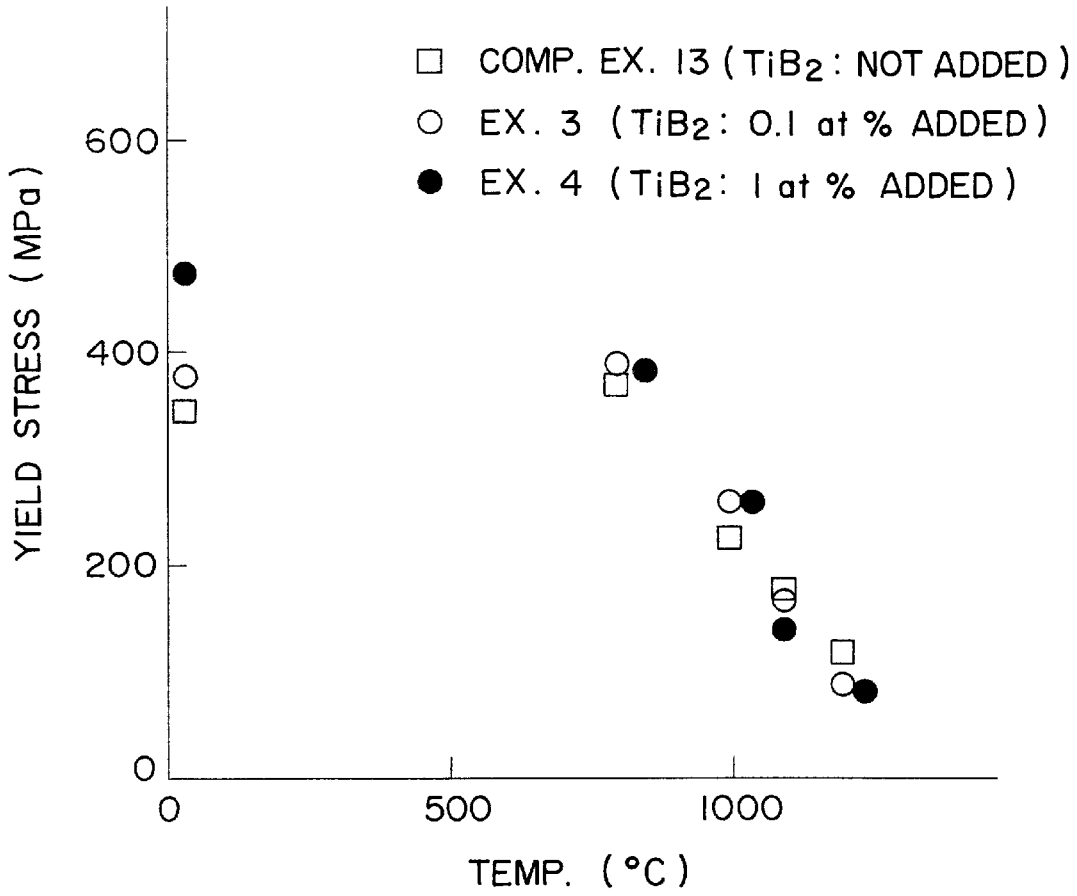
FIG. 11 is a graph showing the tensile strength of TiAl intermetallic compound-base alloy materials, with the amount of $TiB_2$ added being varied (0, 0.1 and 1 at %), produced by direct casting.
Figure 12:
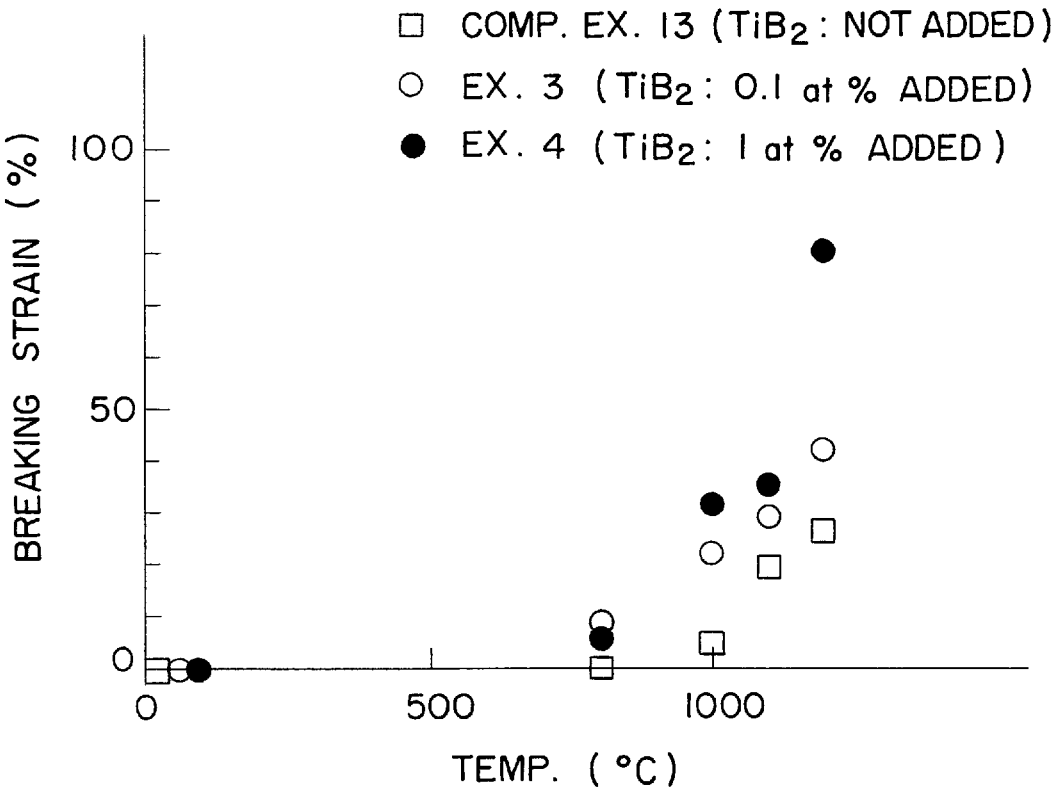
FIG. 12 is a graph showing the ductility of TiAl intermetallic compound-base alloy materials, with the amount of $TiB_2$ added being varied (0, 0.1 and 1 at %), produced by direct casting.

The influence of the addition of $TiB_2$ upon mechanical properties was examined. For the comparative material with $TiB_2$ not added thereto (Comparative Example 13), the material of the present invention with 0.1 at % $TiB_2$ added thereto (Example 3), and the material of the present invention with 1 at % $TiB_2$ added thereto (Example 4), the tensile strength at high temperatures is shown in FIG. 11, and the ductility is shown in FIG. 12.

Further, for the material of the present invention (Example 4), the tensile strength properties at room temperature and those at high temperatures are tabulated in Table 4. For comparison, the tensile strength properties at room temperature and those at high temperatures for the direct cast TiAl material with $TiB_2$ not added thereto (Comparative Example 13) are tabulated in Table 5.

TABLE 4

Tensile strength properties of sheet of Ti-50Al-1TiB$_2$ (Example 4)

| Test temp. (° C.) | Yield stress (MPa) | Tensile strength (MPa) | Ductility (%) |
|---|---|---|---|
| 25 | 450 | 590 | 2.1 |
| 800 | 384 | 540 | 7.4 |
| 1000 | 260 | 340 | 31.4 |
| 1100 | 165 | 197 | 47.2 |

TABLE 5

Tensile strength properties of sheet of Ti-50Al (Comparative Example 13)

| Test temp. (° C.) | Yield stress (MPa) | Tensile strength (MPa) | Ductility (%) |
|---|---|---|---|
| 25 | — | 348 | 0 |
| 800 | 369 | 417 | 0.7 |
| 1000 | 229 | 346 | 4.8 |
| 1100 | 179 | 221 | 20.6 |

As can be seen from the results, for the material of the present invention, the addition of $TiB_2$ could increased the high-temperature ductility without sacrificing the high temperature strength and, in addition, improved the ductility at room temperature from 0% to 2.12%.

Next, the tensile properties at high temperatures of a TiAl intermetallic compound-base alloy produced by the process of the present invention were compared with those of that produced by the conventional process. The process according to the present invention was performed under conditions of twin roll casting and oxygen concentration 2500 ppm, while the conventional process was performed under VIM melt process, isothermal forging, and oxygen concentration 1000 ppm.

Figure 13:
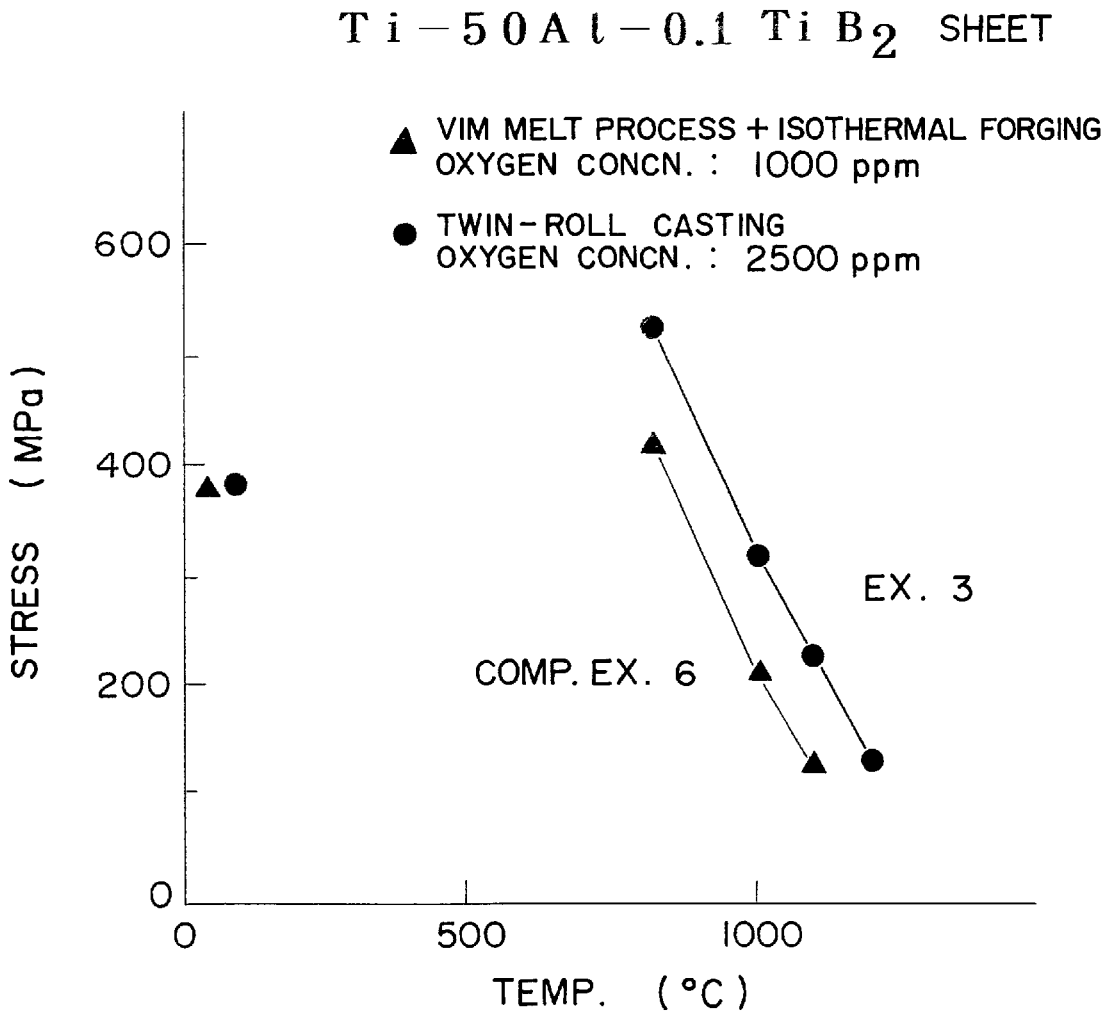
FIG. 13 is a graph showing a comparison between the yield stress/temperature properties of a Ti-50Al-0.1$TiB_2$ sheet produced by the process of the present invention (twin-roll casting, oxygen concentration 2500 ppm) and that produced by the conventional process (VIM melt process, isothermal forging, oxygen concentration 1000 ppm)

For the thin sheet of Ti-50Al-0.1$TiB_2$ produced by the process of the present invention (Example 3) and that produced by the conventional process, the relationship between the yield stress and the temperature is shown in FIG. 13. Further, for the thin sheet of Ti-50Al-1$TiB_2$ produced by the process of the present invention (Example 4) and that produced by the conventional process (Comparative Example 7), the relationship between the yield stress and the temperature is shown in FIG. 14.

Figure 14:
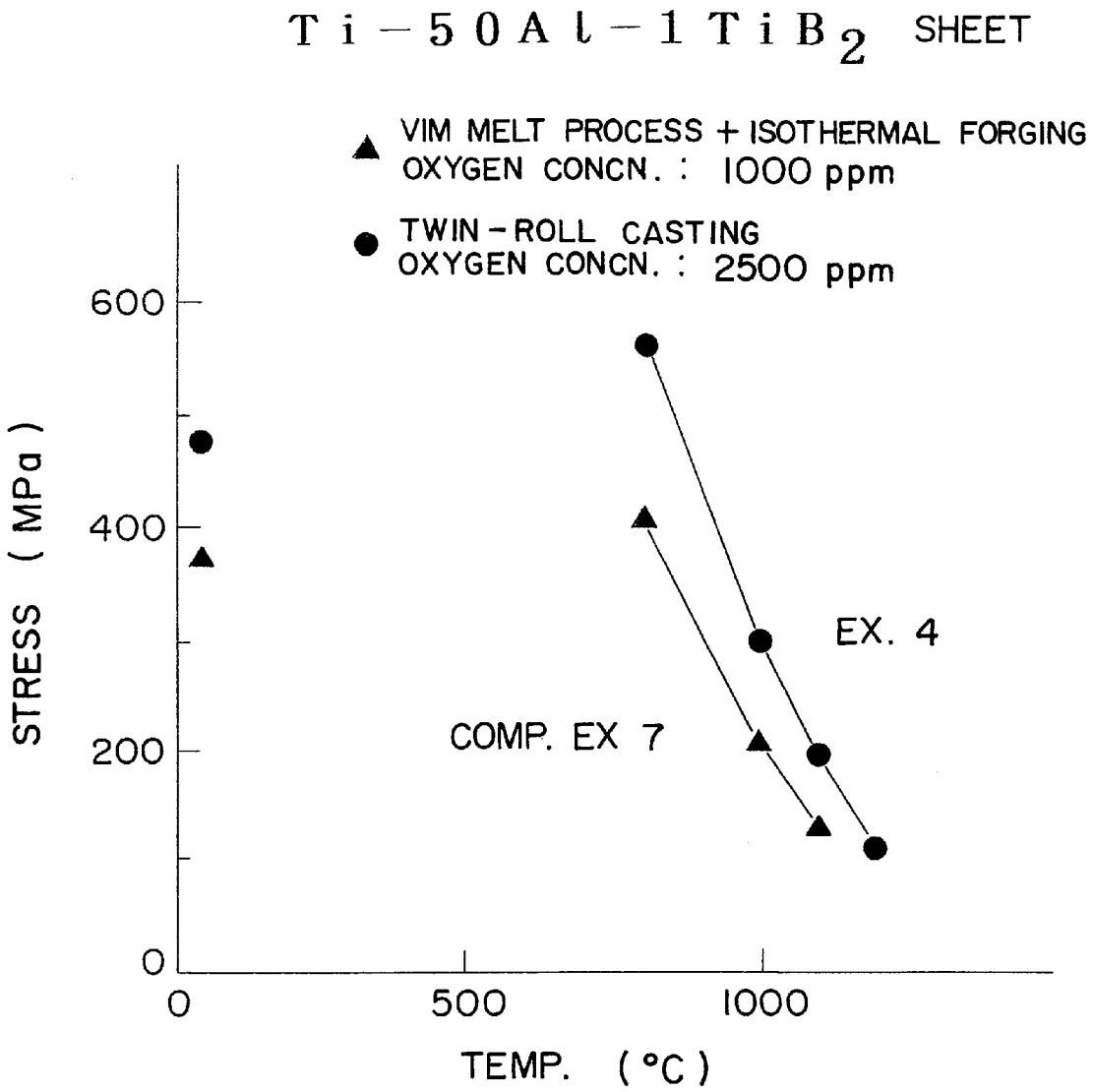
FIG. 14 is a graph showing a comparison between the yield stress/temperature properties of a Ti-50Al-1TiB2 sheet produced by the process of the present invention (twin-roll casting, oxygen concentration 2500 ppm) and that produced by the conventional process (VIM melt process, isothermal forging, oxygen concentration 1000 ppm)

As can be seen from the results shown in FIGS. 13 and 14, the TiAl intermetallic compound-base material produced by the process of the present invention had markedly improved strength at high temperatures.

Figure 15:
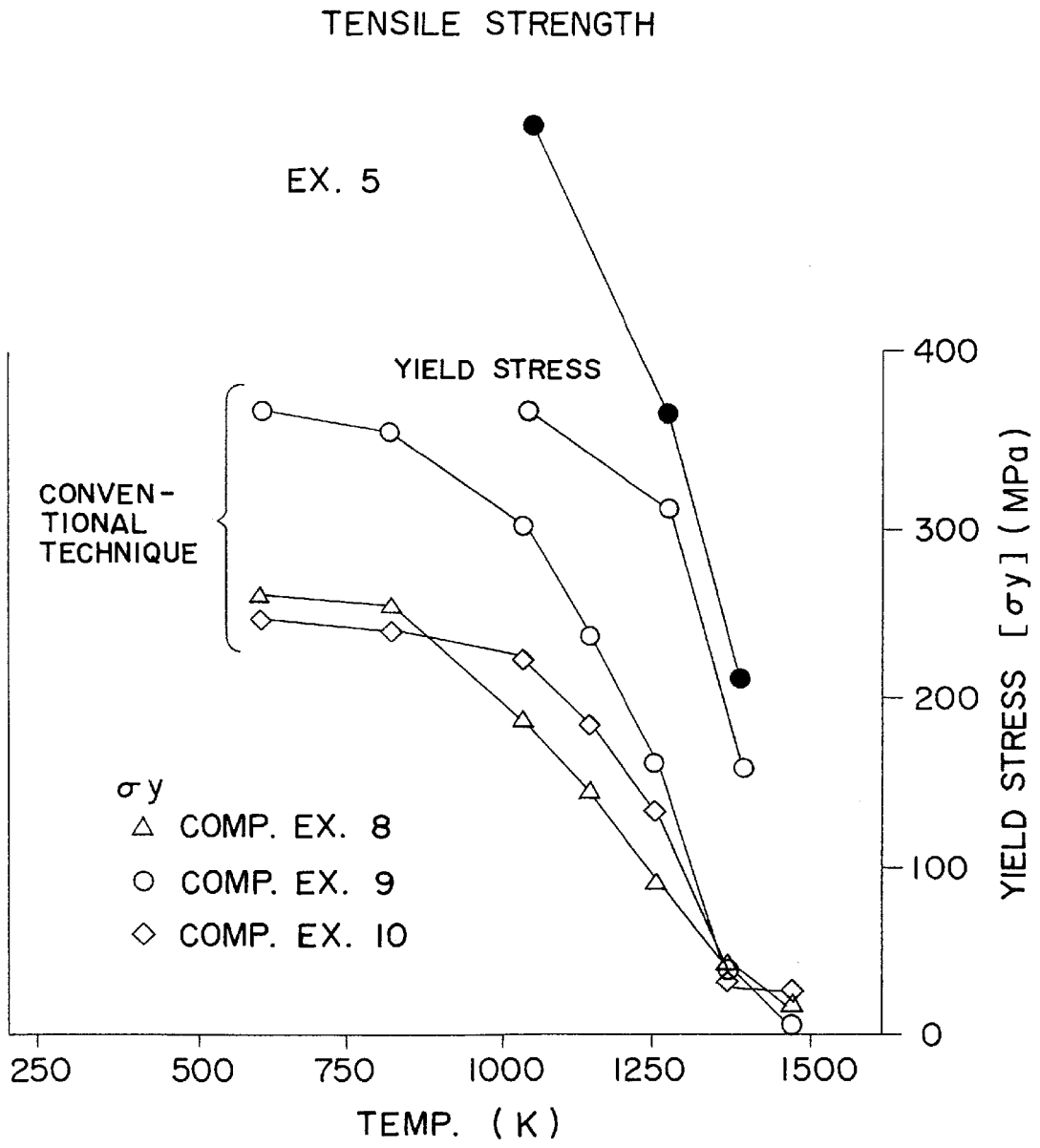
FIG. 15 is a graph showing the comparison between the properties of a Ti—Al intermetallic compound-base alloy material of the present invention and those of a conventional Ti—Al material.
Figure 16:
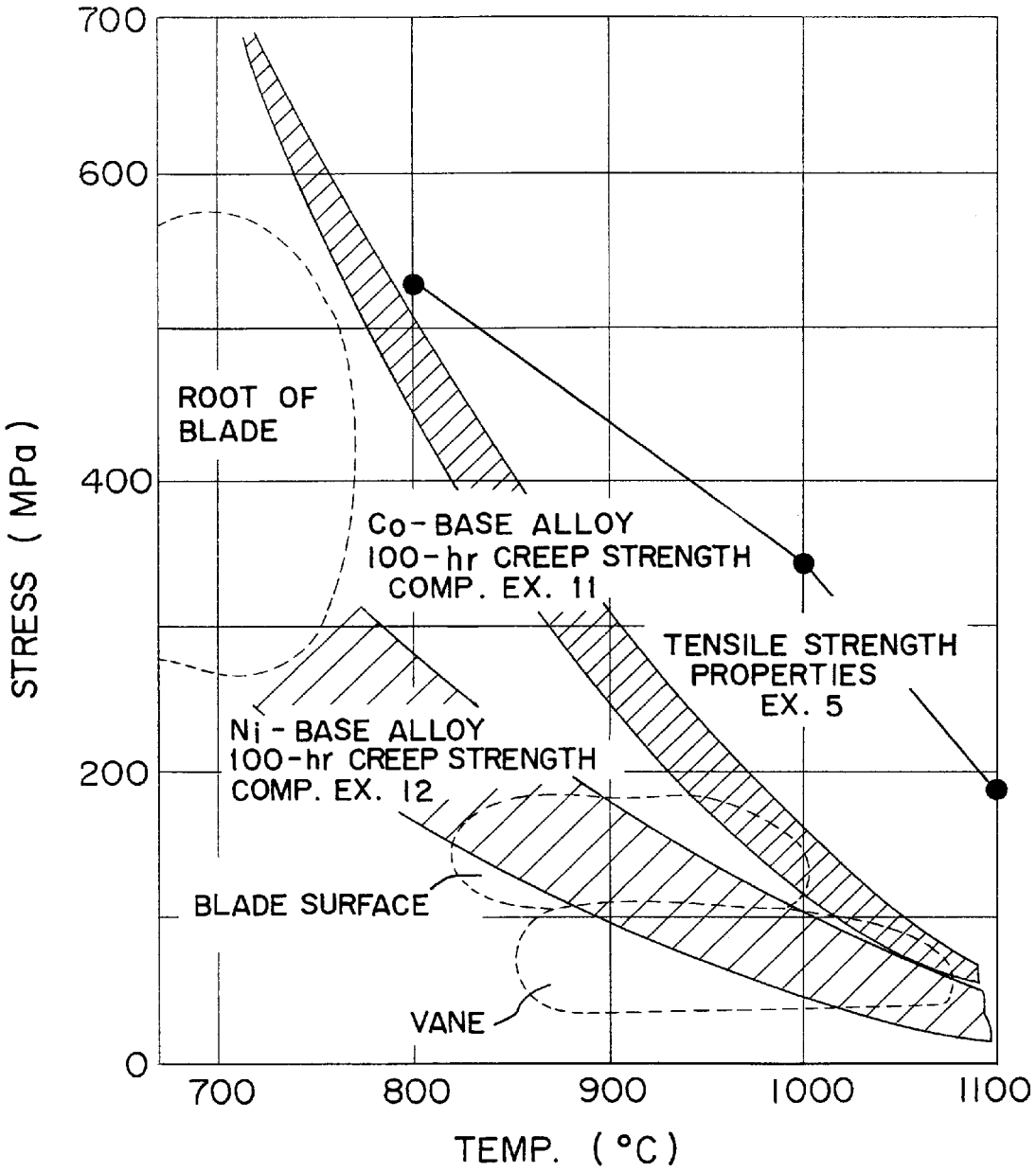
FIG. 16 is a graph showing the comparison between the properties of a Ti—Al intermetallic compound-base alloy material of the present invention and those of superalloys.

Further, as is apparent from the comparison of the properties of the material of the present invention with the conventional TiAl material shown in FIG. 15 and the comparison of the properties of the material of the present invention with those of the superalloys shown in FIG. 16, the properties of the material of the present invention are much superior to those of the conventional high-temperature strength alloys. Further, the specific gravity of the material of the present invention is low and 3.8 which is comparable to that of ceramics, offering high specific strength.

COMPARATIVE EXAMPLES 6 to 13

For comparison, conventional TiAl alloy materials as shown in Table 3, that is, a material having a composition outside the scope of the invention, a material produced by a process other than the process of the present invention, and a commercially available material, were provided.

EXAMPLE 6

An aluminum metal and a sponge titanium were mixed together to give a composition of Ti: 50 at % and Al: 50 at %, and the mixture was melted by high-frequency melting (VIM), whereby a master alloy was prepared by a melt process. In this case, in the final stage of pouring of the molten metal, a $TiB_2$ powder, in an amount corresponding to 1 at %, wrapped in an Al foil was added to the molten metal, thereby dispersing the $TiB_2$ powder in the γTiAl matrix.

The ingot thus obtained was cut into a small piece of about 10×10×10 mm which, together with agate, was placed in a ball mill. The interior of the vessel was once evacuated, and the atmosphere in the interior of the vessel was replaced with Ar, followed ball milling for 24 hr.

The resultant TiAl powder was placed in a stainless steel vessel which was then covered and evacuated. Then, the boundary between the cover and the vessel was subjected to electron beam welding. The TiAl wrapped in the vessel was pressed with a reduction ratio of 80% at a high temperature of 1200° C. by means of a hot press to prepare a sheet.

Thus, fine alumina ($Al_2O_3$) was dispersed in an oxygen concentration in the range of from 1000 to 5000 wt ppm and in a size of particle diameters ranging from 200 to 500 nm. Further, an intermetallic compound-base alloy material comprising TiAl (Ti: 50 to 53 at %, Al: 47 to 50 at %) containing an additive element (at least one of Cr, Mn, and V: 1 to 3 at %) with a boride having a diameter of not more than 500 nm dispersed in a B concentration of 0.1 to 10 at % was prepared.

EXAMPLE 7

An aluminum metal and a sponge titanium were mixed together to give a composition of Ti: 50 at % and Al: 50 at %, and the mixture was melted by high-frequency melting (VIM), whereby a master alloy was prepared by a melt process. In this case, in the final stage of pouring of the molten metal, a $TiB_2$ powder, in an amount corresponding to 1 at %, wrapped in an Al foil was added to the molten metal, thereby dispersing the $TiB_2$ powder in the γTiAl matrix.

The ingot thus obtained was subjected to electrical discharge machining to prepare a cylinder, having a size of 600ϕ×600 mm, which was then hot-pressed with a reduction ratio of 80% under a vacuum of $10^{-6}$ Torr at a temperature of 1200° C. and a strain rate of $5\times10^{-4}$ $sec^{-1}$.

Thus, fine alumina ($Al_2O_3$) was dispersed in an oxygen concentration in the range of from 1000 to 5000 wt ppm and in a size of particle diameters ranging from 200 to 500 nm. Further, an intermetallic compound-base alloy material comprising TiAl (Ti: 50 to 53 at %, Al: 47 to 50 at %) containing an additive element (at least one of Cr, Mn, and V: 1 to 3 at %) with a boride having a diameter of not more than 500 nm dispersed in a B concentration of 0.1 to 10 at % was prepared.

EXAMPLE 8

The TiAl-base intermetallic compound sheets prepared in Examples 3, 4 and 5 were subjected to high-temperature pack rolling with a reduction ratio of 50%, wherein an alumina foil was used as a separating material and packing was carried out using a Ti alloy, under conditions of vacuum $10^{-6}$ Torr, 1200° C. and strain rate $5\times10^{-4}$ $sec^{-1}$. Thus, pack rolling was carried out.

As indicated in each of the above examples, according to the present invention, the resultant cast strips or treated sheets had markedly improved mechanical properties. This improvement is considered to derive from the fact that a reduction in inclusion of impurities resulted in a reduction in oxygen concentration of the material, offering an optimal oxygen content. Further, agitation by high frequency finely divided the oxide, and this state could be frozen by direct twin-roll casting. Further, the formation of an even fine structure by alumina/boride combined precipitation effect could offer a ductility of 2.12% at room temperature while maintaining the strength at high temperatures.

Industrial Applicability

TiAl intermetallic compound-base alloy materials produced according to the present invention have excellent tensile strength at high temperatures and ductility at high temperatures and room temperature and, hence, can be utilized in exhaust valves for automobiles, turbo-chargers, and turbine blades of engines for jet airplanes.

What is claimed is:

1. A process for producing an intermetallic compound base alloy material having excellent room-temperature strength, room-temperature ductility, high-temperature strength, and high-temperature ductility, characterized in that fine $TiB_2$ having a diameter of not more than 500 nm is previously dispersed in the preparation of a master alloy by a melt process, a calcia crucible or an alumina ($Al_2O_3$) crucible coated with a calcia (CaO) powder is used as a crucible in high-frequency melting in the melting of the master alloy, a Ti plate is heated to 800 to 1100° C. in a VIM (Vacuum Induction Melting) vessel to conduct gettering of oxygen present within the vessel, thereby lowering the concentration of oxygen in the atmosphere of the vessel to not more than 0.2%, and casting is carried out in this state to produce an ingot which is then subjected to isothermal forging to bring the structure to a fine grain structure.

2. A process for producing a TiAl foil, the in that a sheet of TiAl produced by a process according to claim 1 is molded by high-temperature pack rolling wherein an alumina foil or a calcia powder is used as a release material and packing is carried out using a Ti alloy or stainless steel.

3. A process for producing an intermetallic compound-base alloy material wherein fine titanium boride ($TiB_2$) particles having a diameter of not more than 500 nm are previously disposed in a master alloy during preparation of the master alloy by a melt process, a calcia (CaO) crucible or an alumina ($Al_2O_3$) crucible coated with a calcia powder is used as a crucible for high-frequency melting of the master alloy in a vacuum induction melting (VIM) vessel, a Ti plate is heated to 800 to 1100° C. in the vessel to conduct gettering of oxygen present within the vessel and thereby lower the concentration of oxygen in the atmosphere of the vessel to not more than 0.2%, and melting of the master alloy and casting of the melted master alloy is carried out in said atmosphere to produce a casting of the alloy material.

4. A process according to claim 3, wherein said casting is a sheet of the alloy material and the sheet is molded to produce a TiAl foil by high-temperature pack rolling in which an aluimina foil or a calcia powder is used as a release material and packing is carried out using a Ti alloy or stainless steel.

5. A process according to claim 3, wherein said casting is an ingot of the alloy material and the ingot is subjected to isothermal forging to produce a fine grain structure.

6. A process according to claim 3, wherein the composition of the master alloy is such that the casting comprises fine alumina ($Al_2O_3$) particles having a particle diameter of 200 to 500 mm and dispersed at intervals of not more than 10 $\mu$m in the matrix to give an oxygen concentration of 1000 to 5000 ppm by weight, titanium boride ($TiB_2$) particles dispersed to give a boron concentration of 0.1 to 10 at %, and TiAl having a Ti content of 50 to 53 at % and an Al content of 47 to 50 at %.

* * * * *